US006064289A

United States Patent [19]

Wieloch et al.

[11] Patent Number: 6,064,289

[45] Date of Patent: May 16, 2000

[54] ELECTROMAGNETIC CONTACTOR WITH OVERLOAD RELAY

[75] Inventors: Christopher J. Wieloch, Brookfield; Kurt von Eckroth, Oconomowoc; David S. Hunter; Mike T. Little, both of Milwaukee; Jan J. Walker, Franklin; James A. Becker, Grafton, all of Wis.

[73] Assignee: Eaton Corporation, Cleveland, Ohio

[21] Appl. No.: 09/267,974

[22] Filed: Mar. 12, 1999

[51] Int. Cl.[7] ..... H01H 67/02

[52] U.S. Cl. ..... 335/132; 335/10; 335/18; 335/202; 335/8

[58] Field of Search ..... 335/6, 8, 10, 18, 335/132, 202

[56] References Cited

U.S. PATENT DOCUMENTS 4,893,102 1/1990 Bauer ..... 335/132

*Primary Examiner*—Lincoln Donovan
*Assistant Examiner*—Raymond Barrera
*Attorney, Agent, or Firm*—Boyle Fredrickson Ziolkowski S.C.; Timothy J. Ziolkowski; Larry Vande Zande

[57] ABSTRACT

An electromagnetic starter with an overload relay having magnetic flux shielding is disclosed for use in industrial contactor applications. The starter includes a multi-pole DC controlled contactor which is interlockingly coupled to an overload relay. The overload relay has a simplified interlocking connection to the contactor, which when made, corresponds to an abutting electrical connection between the contactor and the overload relay also being made. The contactor further has a guiding pin that promotes even contact closure within the contactor.

25 Claims, 6 Drawing Sheets

FIG. 5
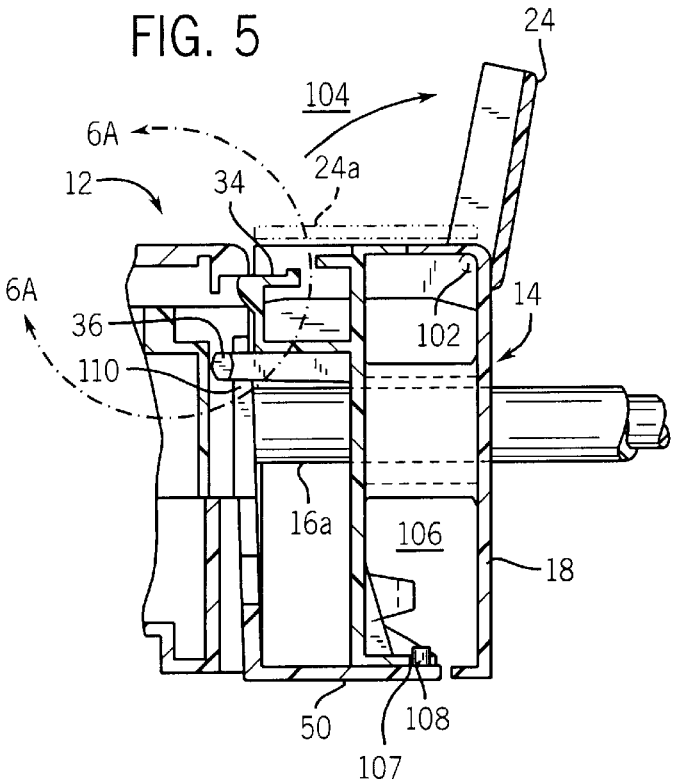
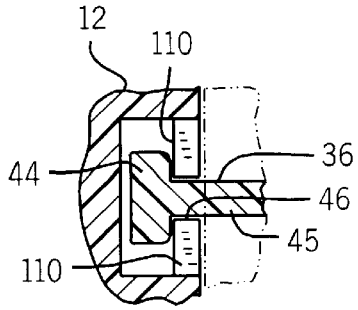
FIG. 6C
FIG. 6A
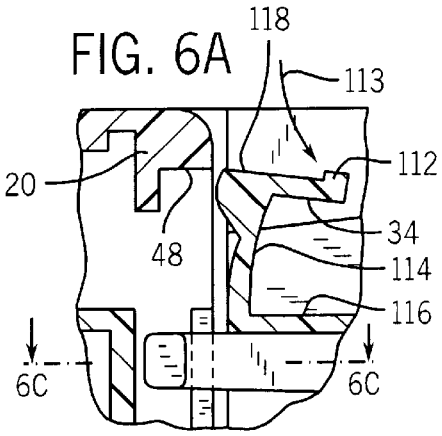
FIG. 7
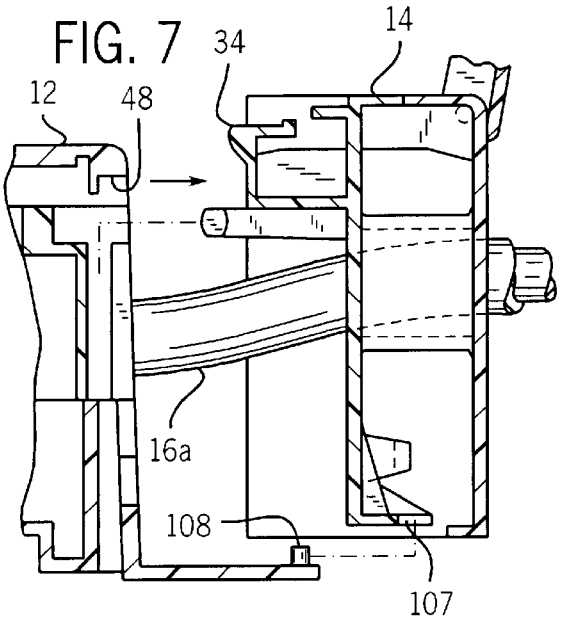
FIG. 6B
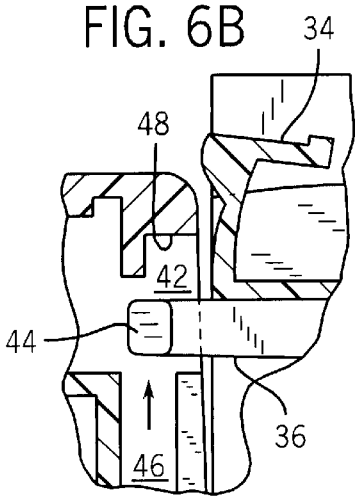

ELECTROMAGNETIC CONTACTOR WITH OVERLOAD RELAY

BACKGROUND OF THE INVENTION

The present invention relates generally to electromagnetic contactors, and more particularly to a contactor which is coupled to an overload relay to form an electric motor starter that provides overcurrent protection in order to prevent current overloading to a load, i.e. a motor.

In electromagnetic starter applications, an overload relay is used to protect a particular load, such as a motor, from excessive currents. Known overload relays incorporate bi-metal switches and heaters in the overload relay connected in series with contacts of the contactor. However, these devices require separate invasive connections between the contactor and overload relay, and their presence increases the cost and size of the starter. Therefore, it would be desirable to have a smaller, lower cost overload relay having a simplified non-invasive connection to the contactor that eliminates the necessity for other devices connected to the contactor.

Another problem associated with the operation of a electromagnetic contactor is a tendency for a moveable contact carrier to lock during travel to and from an energized electromagnetic core. The random locking of the moveable contact carrier prevents the precise control of contactor timing required in industrial contacts.

Therefore, it would be desirable to have an electromagnetic contactor with an overload relay having a simplified non-invasive electrical connection through the overload relay to a contactor, that prevents cross-pole magnetic flux transfer and provides a smooth travel path for a moveable contact carrier in the contactor as it travels to and from an electromagnetic coil.

SUMMARY OF THE INVENTION

The present invention provides an electromagnetic starter that provides a simplified connection between a contactor and an overload relay which provides a simplified non-invasive connection to the contactor, provides more accurate magnetic field sensor readings within the overload relay, and maintains smooth operation of the contactor by providing even contact closure and opening.

The present invention includes a starter having a multi-phase DC controlled contactor. The contactor includes a pair of stationary contacts mounted within a contactor housing. A moveable contact is mounted in operable association with the stationary contacts, and is carried by a moveable contact carrier slidably mounted to the contactor housing. The contactor includes an electromagnetic coil mounted to the contactor housing for attracting the moveable contact carrier. Extending out from the contactor housing is at least one flexible coil terminal attached at one end to the electromagnetic coil. The starter also includes an overload relay interlockingly coupled to the contactor. In a preferred embodiment, the overload relay includes at least one retaining projection which extends from the overload relay and a flexing lock tab integral with each retaining projection. The contactor has a receiving channel to receive the retaining projection and a retaining channel which is narrower than the receiving channel. When the contactor is coupled to the overload relay, the retaining projection enters the receiving channel and proceeds downwardly through the retaining channel until the flexing lock tab snaps into a lip of the contactor. The overload relay is then prevented from being removed from the contactor. The flexible coil terminal abuts an electrical conductor on the printed circuit board to provide the electrical connection between the contactor and the overload relay. A printed circuit board resides within the overload relay housing for controlling power to the contactor.

Various other features, objects and advantages of the present invention will be made apparent from the following detailed description and the drawings.

BRIEF DESCRIPTION OF THE DRAWINGS

The drawings illustrate the best mode presently contemplated for carrying out the invention.

In the drawings:

FIG. 5 is a partial cross-sectional view taken along line 5—5 of FIG. 1

FIG. 6A is an enlarged partial view of section 6A of FIG. 5 showing the initial disengagement of the overload relay from the contactor.

FIG. 6B is a view similar to that of FIG. 6A but with the overload relay further disengaged from the contactor.

FIG. 6C is a partial cross-sectional view taken along line 6C of FIG. 6A showing the retention of the retaining projection of the overload relay by the contactor housing.

FIG. 7 is a view similar to that of FIG. 5, but with the overload relay disconnected from the contactor.

DETAILED DESCRIPTION OF THE PREFERRED EMBODIMENT

Figure 1:
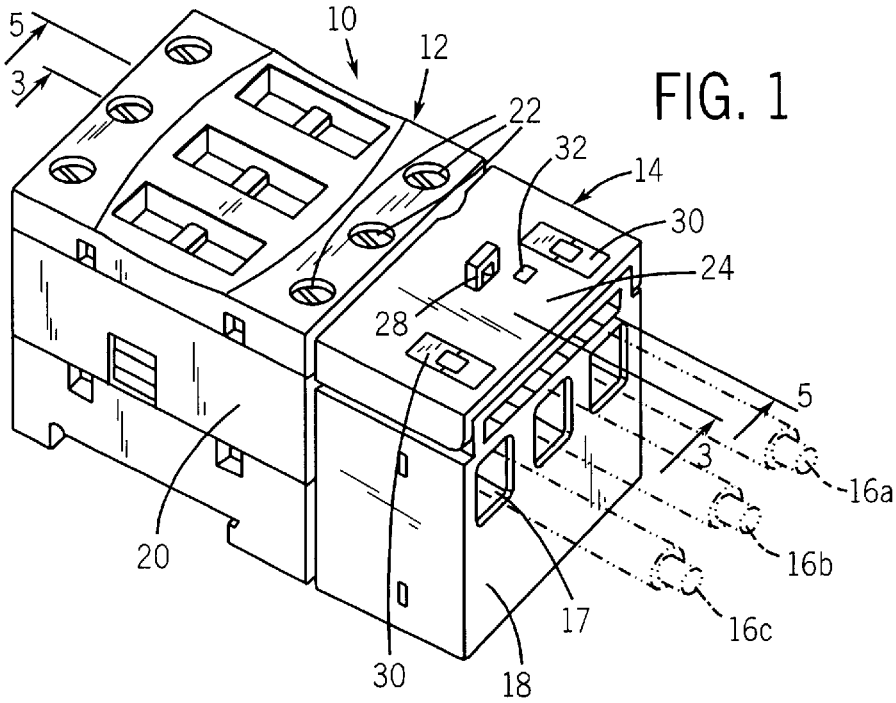
FIG. 1 is a perspective view of a contactor with an overload relay connected thereto to form a motor starter in accordance with the present invention.

Referring to FIG. 1, a starter 10 is shown in perspective view. Starter 10 is a multi-phase DC starter as is used in industrial control applications, such as motor control, and includes contactor 12 and overload relay 14. Contactor 12 is an electromagnetic contactor for switching supply current to a motor (not shown), while the overload relay 14 senses and measures the current to the motor, and shuts off or de-energizes the contactor 12 if too much current (overload) is flowing to the motor, thus protecting the motor. Overload relay 14 is shown connected with the contactor 12. Overload relay 14 accepts a series of conductors 16*a*, 16*b* and 16*c* (shown partially in phantom) through overload relay housing 18, to contactor housing 20 to be secured by lugs 22. Overload relay 14 includes a pivotable cover 24 shown in a cover closed position. Overload relay cover 24 further includes an aperture (26 of FIG. 2) such that when cover 24 is in the cover closed position, a locking hasp 28 extends through cover 24 via aperture 26. Other items such as switches 30 and LED indicator 32 may also show through or extend through cover 24 in a similar manner.

Figure 2:
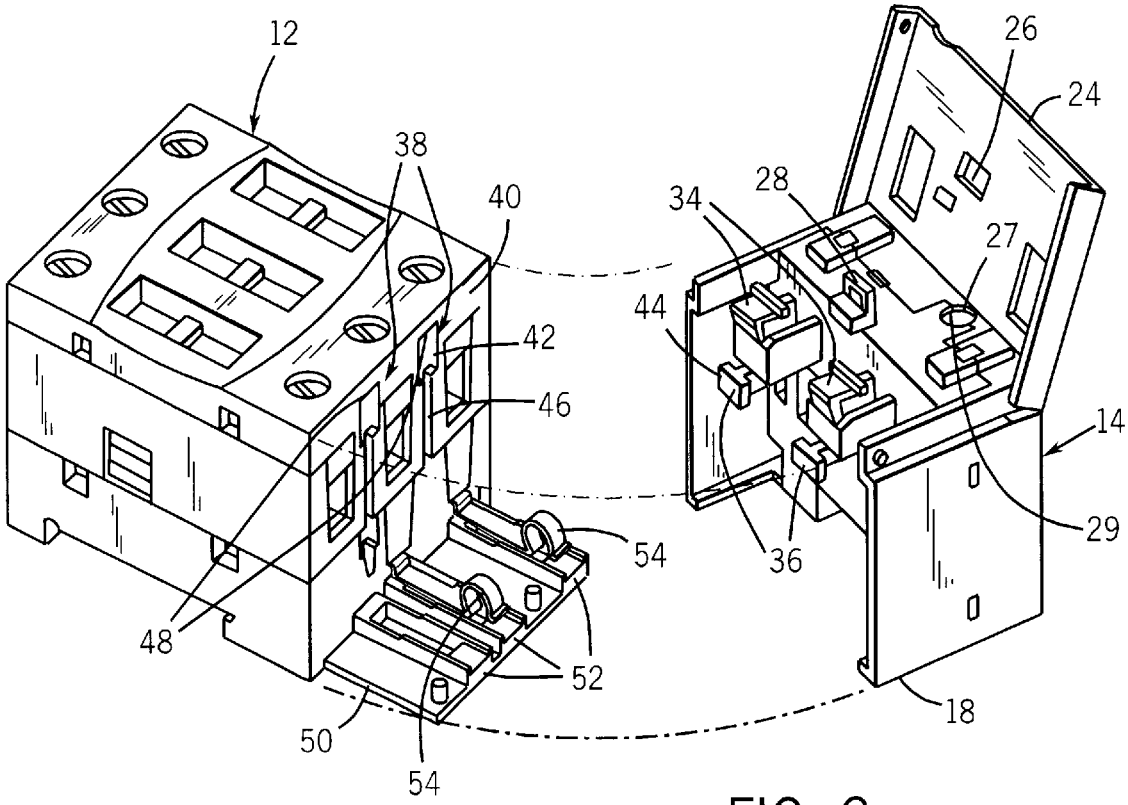
FIG. 2 is a perspective view of the starter of FIG. 1 with the contactor and the overload relay separated.

Referring to FIG. 2, the cover 24 of the overload relay 14 is shown in a cover open position. The cover 24 in the cover open position permits visualization of conductors 16*a*, 16*b* and 16*c* (of FIG. 1) as inserted through openings 17 in the overload relay 14 and into the contactor 12 during installation. Overload relay housing 18 includes a circular opening through which the rotary knob of a potentiometer 27 connected to a printed circuit board is disposed. Potentiometer 27 includes a screwdriver type slot 29 for adjustment of the full load amperage of the particular motor with which the starter 10 is to be used. Potentiometer 27 is covered when cover 24 is in the cover closed position, and a seal inserted through locking hasp 28 prevents unknown later adjustment of potentiometer 27.

Contactor 12 is shown separated from overload relay 14 to better show the connection therebetween. In order to make the connection, the overload relay 14 includes flexing lock tabs 34, which are each connected to a retaining projection 36. Preferably, retaining projection 36 is T shaped as will be described in further detail with respect to FIGS. 6A–6C. Retainer projections 36 are insertable into connecting slots 38 within housing wall 40 of contactor 12. Each connecting slot 38 preferably has a general T shape with a receiving channel 42 for initially receiving the head 44 of retaining projection 36. Receiving channel 42 terminates at one end in a retaining channel 46 which is narrower than the receiving channel 42. During connection, the retaining projection 36 enters the receiving channel 42 and proceeds downwardly through the retaining channel 46. Preferably, the head 44 of retaining projection 36 is wider than the retaining channel 46, thereby preventing removal of retaining projection 36 through retaining channel 46. The retaining projection 36 proceeds downwardly through retaining channel 46 until flexing lock tabs 34 snap under lip 48 of contactor housing wall 40. One of ordinary skill will recognize that a different number of retaining projections 36 and connecting slots 38 may be utilized to accomplish a similar connection.

The contactor 12 includes a platform 50 which is integral with and extends substantially transversely to the plane of contactor wall 40. Platform 50 includes supports 52 for supporting flexible coil terminals 54 which extend outwardly from within the contactor 12. Although two flexible coil terminals are shown, it is contemplated that other numbers and arrangements of flexible coil terminals may be utilized. When coupled, the overload relay 14 is placed over the platform 50 to make an electrical connection with flexible coil terminals 54.

Figure 3:
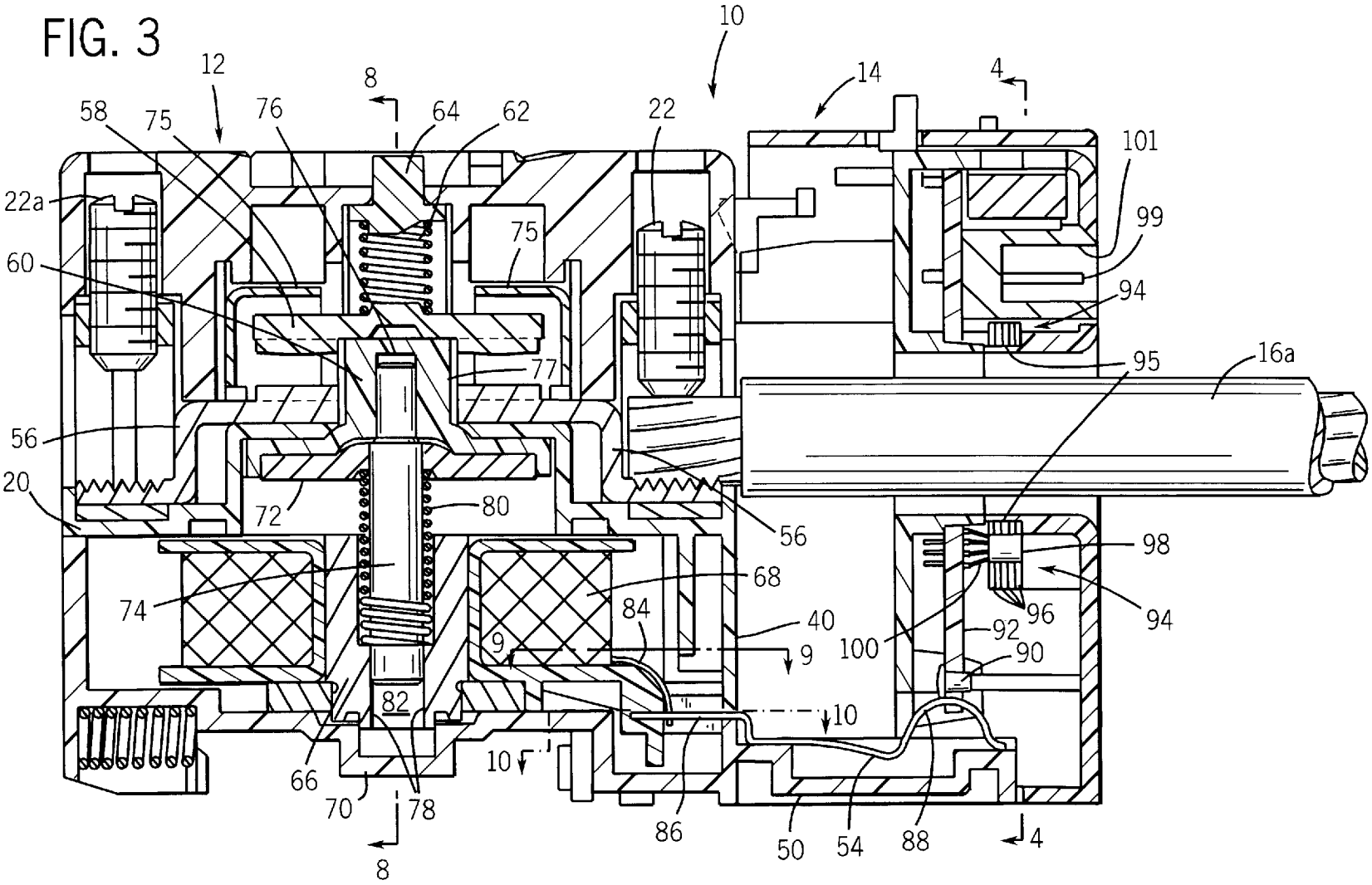
FIG. 3 is a cross-sectional view taken along line 3—3 of FIG. 1. with the contactor and the overload relay connected.

Referring to FIG. 3, the starter 10 is shown with contactor 12 connected to the overload relay 14. The overload relay 14 has a simplified connection to the contactor 12 that includes a snap fit physical connection and an abutting electrical connection, which occur at substantially the same time.

Contactor 12 includes stationary contacts 56 mounted to the contactor housing 20. A moveable contact 58 is mounted 5 to a moveable contact carrier 60. The moveable contact 58 is biased toward the stationary contacts 56 by a moveable contact biasing mechanism 62 which is located between the upper enclosure 64 of the moveable contact carrier 60 and the moveable contact 58.

A magnetic core 66 surrounded by electromagnetic coil 68 in a conventional manner is located on a base portion 70 of contactor housing 20. The magnetic core 66 is preferably a solid iron member. Electromagnetic coil 68 preferably runs on direct current and is controlled to limit current after device pick-up. As a result, magnetic core 66 need not be as large as alternating current electromagnet counterparts having similar power capabilities. The overall size of contactor 12 is therefore reduced. When energized, magnetic core 66 attracts armature 72 which is connected to 20 moveable contact carrier 60. Moveable contact carrier 60 along with armature 72 are guided towards the magnetic core 66 with guide pin 74.

Guide pin 74 is press-fit or molded securely into moveable contact carrier 60 at one end in an inner surface 76. Guide pin 74 is slidable along guide surface 78 within magnetic core 66. The single guide pin 74 is centrally disposed and is utilized in providing a smooth and even path for the armature 72 and moveable contactor 60 as it travels to and from the magnetic core 66, preventing the side to side motion during movement caused by uneven movement and partial locking of the moveable contact carrier 60. Moveable contact carrier 60 is guided at its upper end 77 by surfaces on the contactor housing 20. Guide pin 74 is partially enclosed by a resilient armature return spring 80, which is compressed as the moveable contact carrier 60 moves toward the magnetic core 66. Armature return spring 80 biases the moveable contact carrier 60 and armature 72 away from magnetic core 66. The combination of the guide pin 74 and the armature return spring 80 helps to provide even downward motion of the moveable contact carrier 60 and helps prevent tilting or locking that may occur during contact closure. The moveable contact carrier 60 is guided along guide surface 78 to help provide a more level path to the magnetic core 66. Additionally, lower end 82 of guide pin 74 may be used to cushion or dampen the downward movement at the end of its downward movement, such as in a dash-pot capacity, to help reduce bounce and cushion the closure of the armature 72 with magnetic core 66. Appropriate tolerancing of the guide pin 74 surfaces 78 and housing 20 promotes its use in this capacity.

Turning now to the electrical connection between the contactor 12 and the overload relay 14, a coil extension 84 extends from electromagnetic coil 68. As will be further described in FIGS. 9–10, coil extension 84 is connected to a flexible coil terminal 54. The flexible coil terminal 54 extends outwardly from wall 40 of contactor 12. Flexible coil terminal 54 extends onto and rests upon platform 50 so as to position itself to abuttingly engage an electrical conductor or rivet 90 which is part of printed circuit board 92 of the overload relay 14. In operation, power is supplied to the printed circuit board 92 through a connector 99, which is sized to receive, for example, a JP1 eight pin connector that plugs into the opening 101 of the overload relay 14. Electrical power is directed through the printed circuit board 92 so as to be available through rivet 90 to establish an electrical connection to the coil 68 when the flexible coil terminal 54 contacts rivet 90, as occurs when the overload relay 14 is snap fit onto contactor 12. By this means the coil power can be modulated to reduce quiescent power in the device.

Conductor 16*a*, as is the case with conductors 16*b* and 16*c*, extends through the overload relay 14 into contactor 12 and secured by lugs 22. It is understood that similar connections are made on the opposite side of contactor 12 such that other conductors may be inserted therein and secured by lug 22*a* to complete a current path to contactor 12.

As will be discussed in greater detail in the discussion of FIG. 4, overload relay 14 includes a magnetic flux concentrating shield 94. Preferably, because of the desirability of manufacturing the magnetic flux concentrating shield 94 by a stamping process, it is made up of thin layers of laminated members 96 secured together. A magnetic field sensor, such as a Hall sensor 98, is inserted in the air gaps surrounding each Hall sensor 98. The Hall sensor 98 is connected to printed circuit board 92 by leads 100 and is soldered to the printed circuit board 92, such that it stands off from the printed circuit board 92. The magnetic flux concentrating shield 94 is precisely positioned in the overload relay housing 20 about wall 95 so as to preserve the alignment of Hall sensor 98. Hall sensor 98 and magnetic flux concentrating shield 94, in combination with printed circuit board 92, provide the necessary current measuring circuitry such that the contactor 12 is protected from and can be disabled during overload currents.

Figure 4:
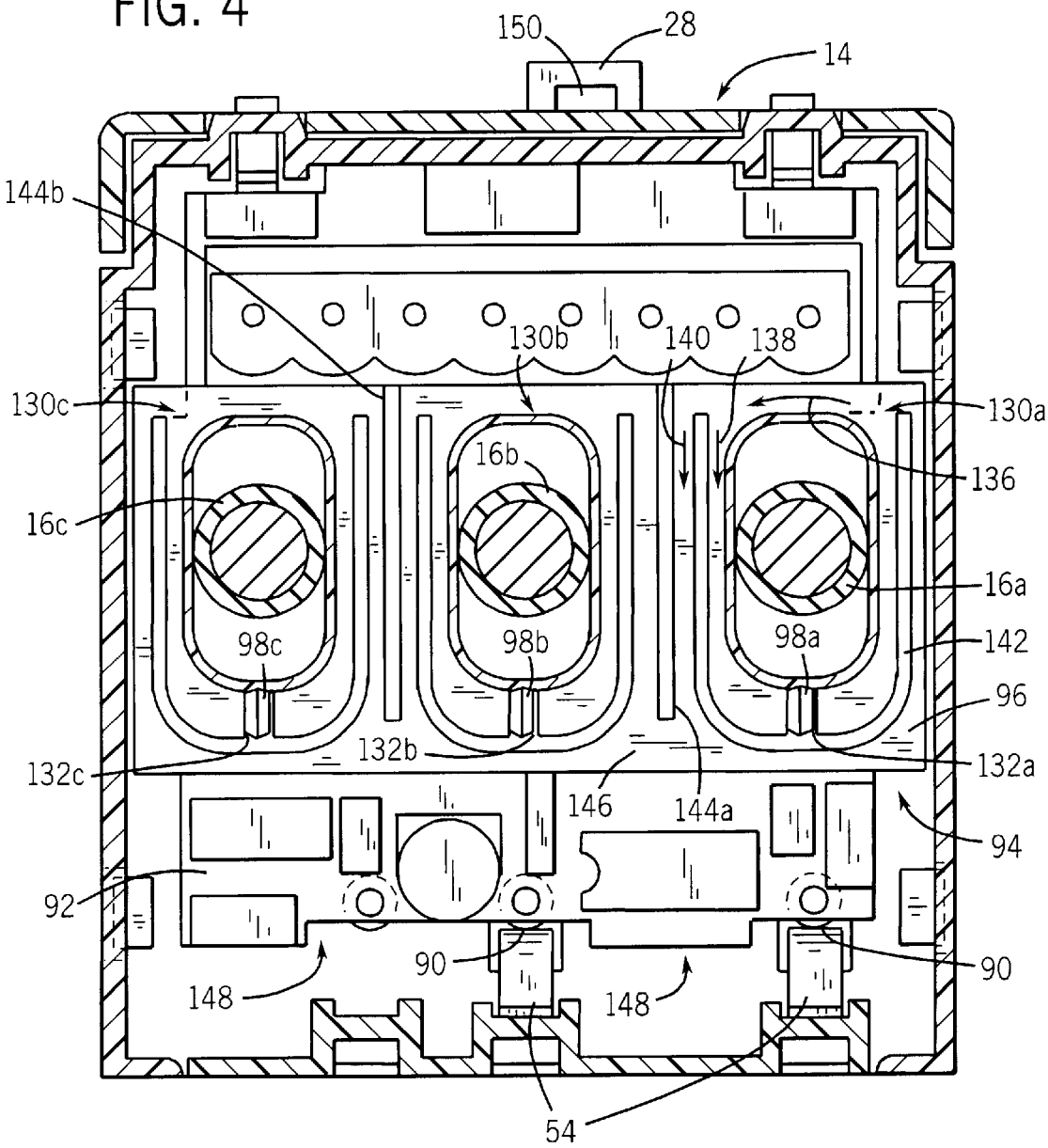
FIG. 4 is a lateral cross-sectional view of the overload relay taken along line 4—4 of FIG. 3.

FIG. 4 is a cross-sectional view of the overload relay 14, and as previously described, includes a magnetic flux concentrating shield 94, which is preferably made up of layers of laminated members 96. Each laminated member 96 includes a pole section 130*a*, 130*b* and 130*c* for the reception of conductors 16*a*, 16*b* and 16*c* therethrough respectively. Each pole section 130*a*, 130*b* and 130*c* includes an air gap 132*a*, 132*b*, and 132*c* into which resides a magnetic field sensor, such as Hall sensors 98*a*, 98*b* and 98*c*. Hall sensors are utilized because they are small and fit easily within the space available in the overload relay. Because of the reduced available area, the spacing between individual poles can cause the Hall sensor in one pole to sense (additional) stray flux from an adjacent pole. The Hall sensors 98*a*–98*c* stand off from the surface of the printed circuit board 92 so as to be self aligning within the air gaps 132*a*–132*c*. The printed circuit board 92 and the magnetic flux concentrating shield 94 are both secured within the overload relay housing 20, FIGS. 3 and 4, so as not to disturb the precise placement and orientation of the Hall sensors, which must be positioned with their sensitive faces perpendicular to the direction of flux. During operation, current flows through conductor 16*a* in a direction passing transversely through the laminated member 96 upwardly from the plane of FIG. 4. Such a current creates a magnetic flux path in a counter clockwise direction as indicated by arrow 136. Flux path 136, for example, is divided between primary flux path 138 and secondary flux path 140 which are divided by U shaped channel 142. Outer flux path 140, which provides an avenue for stray magnetic flux, is substantially prevented by pole shielding slot 144*a* from traveling directly to pole section 130*b*. The magnetic flux to be measured is concentrated into primary flux path 138, where it must jump through the air gap 132*a*, and ultimately through Hall sensor 98*a*. The elongated path created by pole shielding slots 144*a* and similarly 144*b* not only concentrates the magnetic flux for a particular pole into the Hall sensor for that pole, but also prevents the magnetic flux from taking the elongated path, thereby shielding the adjacent poles with their Hall sensors 98*a*, 98*b* and 98*c* from the effects of cross pole magnetic flux interference. U-shaped channels 142, it will be recognized, also prevent magnetic flux from influencing Hall sensors 98*a*, 98*b* and 98*c*, and therefore are considered pole shielding slots as well. Additionally, it will be recognized that more pole shielding slots such as 144*a* and 144*b*, and additional channels 142, in various configurations and shapes, may also be utilized to prevent the cross-pole magnetic flux interference.

Although two pole shielding slots 144*a* and 144*b* and three U-shaped channels such as 142 are shown, any number, configuration and placement of the pole shielding slots and U-shaped channels that prevent flux transfer between pole sections is contemplated by the present invention.

As previously described, Hall sensors 98*a*–98*c* are electrically connected to printed circuit board 92. Printed circuit board 92 includes various control circuitry and microprocessors (collectively 148). The control circuitry 148 provides DC control utilizing pulse width modulation. The pulse width is adjustable such that the magnetic coil is overpowered at start-up and then cut back during continued running. The adjustable pulse width modulation utilized by the control circuitry 148 promotes lower inertia and shorter length strokes of the moveable contact carrier (60), which reduces contact bounce and extends the mechanical life of the contacts.

Locking hasp 28 is shown extending from overload relay 14. The locking hasp includes a securing hole 150, in which a tamper resistant seal, such as a wire or lead seal, to prevent unauthorized opening of the cover 24.

As previously described, the conductor rivets 90 are shown abutting the flexible coil terminal 54.

Referring now to FIG. 5, the contactor 12 is shown connected to the overload relay 14. Cover 24 is shown in the cover open position. Cover 24 is pivotable about pivot point 102 (shown in phantom) to go from the phantomed closed position 24*a* in a direction indicated by arrow 104. Opening of the cover of 24 permits viewing of the conductors 16*a*–16*c* (as for installation purposes) such that the interior 106 of the overload relay as well as any conductor wiring, is visible and accessible. For example, although not specifically shown here, a potentiometer adjustment screw 27 used to set operating current ranges may be covered by cover 24 in order to adjust circuit timing and delay functions. The opening of cover 34 also allows access to the interconnection of contactor 12 with the overload relay 14.

Turning now to the physical connection between the contactor 12 and the overload relay 14, the contactor platform 50 has at least one, and preferably two extensions 108 extending transversely therefrom, which are insertable into a recess 107 of the overload relay housing 18 in fitting engagement. To make the upper connection, and as previously described, the overload relay 14 includes flexing lock tab 34, which is shown in its locked position. Flexing lock tab 34 is connected to retaining projection 36, which is shown in its corresponding retained position against inner wall surface 110 of contactor 12.

As best seen in FIG. 6C, retaining projection 36 preferably is formed in a T shape having a head 44 and a narrower stem 45 which is sized to fit within retaining channel 46. In the interlocked position as shown, the head 44 of the retaining projection 36 is prevented from being removed from the contactor 12 by the interior wall 110, thereby maintaining, in combination with the flexing lock tab 34, the interconnection of the contactor 12 with the overload relay 14.

Referring now to FIG. 6A, when it is desired to remove the overload relay 14 from the contactor 12, a force applied near ridge 112 in the direction indicated by arrow 113 causes lock tab 34 to flex along stem 113 with respect to fixed lock tab base 116 permitting an edge at 118 of the flexing lock tab 34 to clear the lip 48 of the contactor housing 20.

Referring now to FIG. 6B, when flexing lock tab 34 clears lip 48, retaining projection 36 may be lifted through retaining channel 46 until the head 44 is able to be withdrawn through and clear receiving channel 42.

FIG. 7 shows the removal of the overload relay 14 from the contactor 12. Extension 108 is removed from inner portion 107 contemporaneously with the removal of the flexing lock tab 34 from lip 48. The overload relay 14 is free to slide along conductor 16*a* (as well as the other conductors) so that the overload relay 14 may be slid up to contactor 12 and then later physically connected thereto if so desired.

Figure 8:
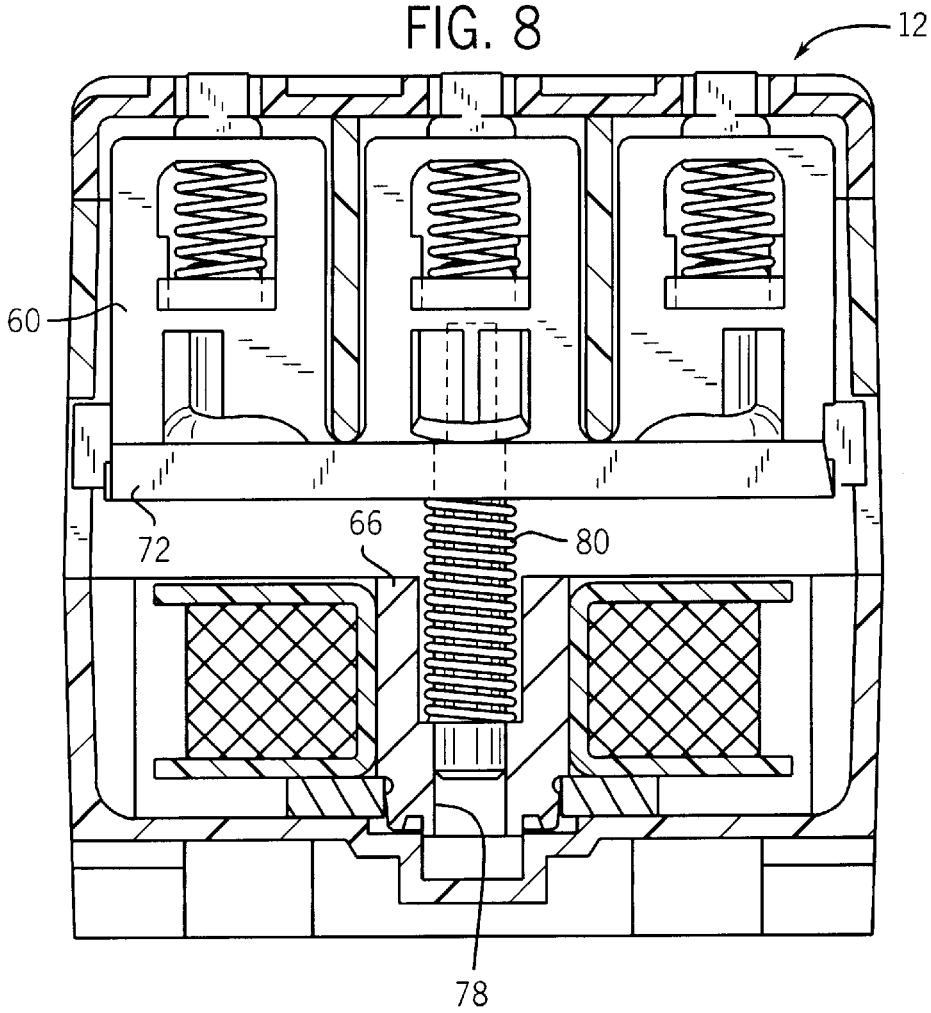
FIG. 8 is a lateral cross-sectional view of the contactor taken along line 8—8 of FIG. 3.

FIG. 8 shows a cross-sectional view of the contactor 12. When the moveable contact carrier 60, along with armature 72 are attracted towards the energized magnetic core 66, the armature 72 exerts a compressive force against resilient armature return spring 80. Together with guide pin 74, the moveable contact carrier 60 and the armature 72, along guide surface 78 in order to provide a substantially level and even travel path for the moveable contact carrier 60.

Figure 9:
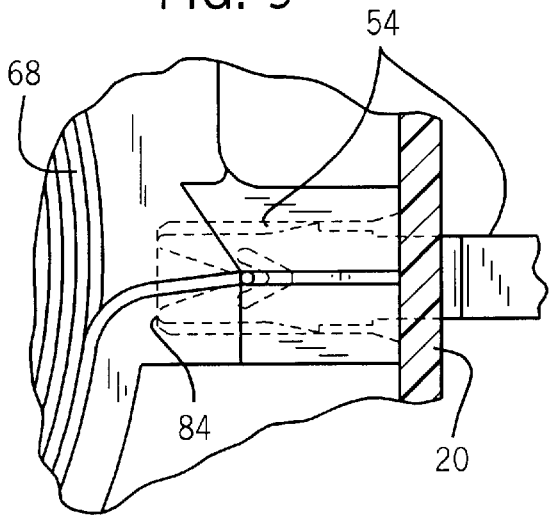
FIG. 9 is a partial cross-sectional view taken along line 9—9 of FIG. 3.

Referring now to FIG. 9 a close-up is shown of the connection between the electromagnetic coil 68 and the flexible coil terminal 54, shown partially in phantom. A piece of the coil wire, shown as coil extension 84, extends from electromagnetic coil 68 and through contactor housing 20. It is the connection between the flexible coil terminal 54 and the coil extension 84 that permits the selective energization of electromagnetic coil 68.

Figure 10:
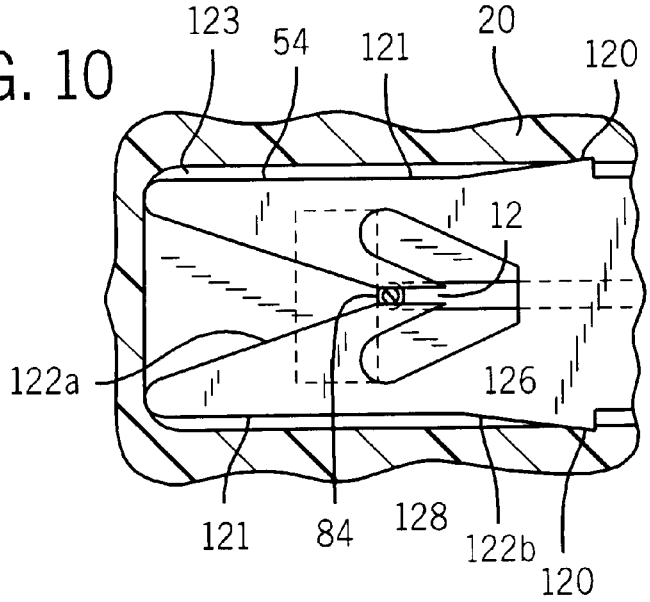
FIG. 10 is a partial cross-sectional view taken along line 10—10 of FIG. 3.

As best seen in FIG. 10, the flexible coil terminal 54 is inserted through contactor housing 20 into a slot 123 molded into insulation bobbin of coil 68, and is prevented from being removed by a series of barbs 120 along the longitudinal edges 121 of the flexible coil terminal 54. The direction of the coil extension 84 is substantially transverse to the direction of the flexible coil terminal 54. Flexible coil terminal 54 includes V shaped sections 122*a* and 122*b*. During the connection process, the coil extension 84 is directed by sections 122*a* and 122*b* along striping channel 124. The coil extension 84 initially has an insulation layer 126 surrounding the actual conducting portion 128. As the flexible coil terminal 54 is inserted into the contactor housing 20, the edges of the striping channel 124 cut into the installation layer 126, in order to provide electrical contact between the coil extension 84 and the flexible coil terminal 54.

Figure 11:
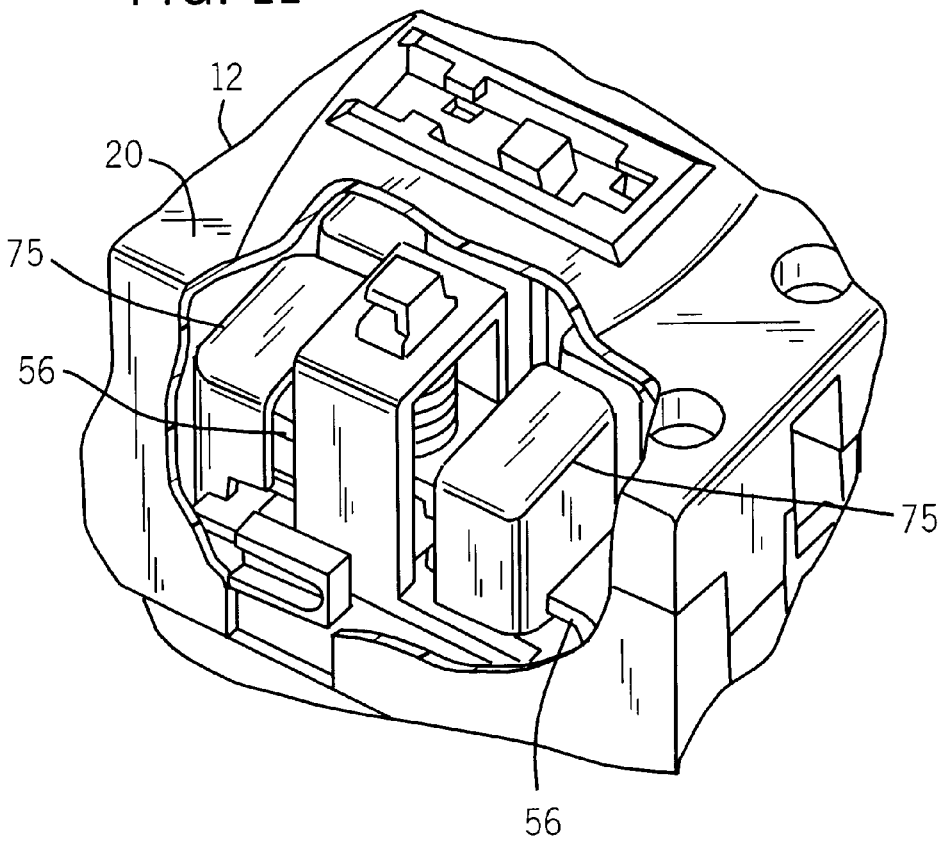
FIG. 11 is a partial perspective view of the contactor of FIG. 1 with the contactor housing partially removed to show the arc shields in accordance with one aspect of the present invention.

Referring now to FIG. 11, the contactor 12 is shown with the contactor housing 20 partially removed to reveal a pair of arc shields 75 which cover a portion of stationary contacts 56. The purpose for the arc shields 75 is to contain any generated electrical arcs and gases as a result of arcing within the confines of the arc shields 75. Therefore, it is important to minimize any gaps between the arc shield 75 and the stationary contacts 56. To that end, it is preferred that the arc shields are deep drawn as opposed to fabrication by folding to eliminate any gaps to produce a contained environment about the stationary contacts 56. The presence of the arc shields 75 prevents carbon build-up inside the contactor housing 20. Preferably there are two arc shields per pole, for a total of 6 arc shields 75 in a three pole contactor.

The present invention has been described in terms of the preferred embodiment, and it is recognized that equivalents, alternatives, and modifications, aside from those expressly stated, are possible and within the scope of the appending claims.

For example, many types of interlocking connections are possible between the contactor 12 and the overload relay 14.

Additionally, the magnetic flux concentrating shield 94 may have many combinations and sizes of pole shielding slots and channels to effectively prevent cross-pole magnetic flux sensor corruption.

Alternately, in another contemplated embodiment, the contactor 12 may be interlocked and snap-fit with a housing structure similar to overload relay 14 without the overload relay function. In such an embodiment, the housing structure would house the printed circuit board 92 without the overload relay circuitry and magnetic flux shielding (i.e., a de-populated board) but maintain the ability to make an abutting electrical connection to the contactor 12 via conducting rivet 90 (FIG. 3). In such a structure, various snap-fit connections are possible, including the snap-fit flexing lock tabs extending from different points along the printed circuit board housing, to connect the printed circuit board housing to the contactor. The printed circuit board housing in such an embodiment would not be utilized for overload relay purposes. Therefore, the new embodiment of the contactor with the coupled printed circuit board housing would not be utilized as a starter, although a similar electrical connection between the contactor 12 and the printed circuit board housing is made, and pulse width modulation of the electromagnetic coil is maintained.

We claim:

1. A starter comprising:

a multi phase DC controlled contactor comprising:

at least one stationary contact mounted within a contactor housing;

a moveable contact mounted in operable association with the stationary contact;

a moveable contact carrier slidably mounted to the contactor housing;

an electromagnetic coil mounted to the contactor housing for attracting the moveable contact carrier;

at least one flexible coil terminal attached at one end to the electromagnetic coil and extending out through the contactor housing; and an overload relay interlockingly coupled with the contactor and including a printed circuit board residing within a overload relay housing for controlling power to the contactor coil;

wherein an abutting electrical connection between the flexible coil terminal and the printed circuit board is made when the overload relay is coupled to the contactor.

2. The starter of claim 1 wherein the contactor further includes a reciprocating guide pin attached to the moveable contact carrier and moveable along at least one guide surface such that the moveable contact carrier and the guide pin have a substantially smooth path while traveling along the guide surface.

3. The starter of claim 1 wherein the contactor further includes an arc shield attached to the contactor housing at each stationary contact and wherein the arc shield is deep drawn to eliminate openings and facilitate electrical arc retention and gas containment within the arc shield, thereby avoiding carbon build-up within the contactor housing.

4. The starter of claim 1 wherein the electromagnetic coil is controlled by an electronic controller on the printed circuit board in the overload relay.

5. The starter of claim 1 wherein the contactor further comprises a platform extending from the contactor housing and having a plurality of coil terminal supports attached thereto, and wherein the overload relay further comprises at least one retaining projection extending from the overload relay and a flexing lock tab integral with each retaining projection;

wherein the contactor has a receiving channel to receive the retaining projection and a retaining channel narrower than the receiving channel such that when the contactor is coupled to the overload relay the retaining projection enters the receiving channel and proceeds downwardly through the retaining channel until the flexing lock tab snaps into a lip of the contactor, thereby preventing removal of the overload relay from the contactor; and wherein when the contactor is coupled to the overload relay the flexible coil terminal abuts an electrical conductor on the printed circuit board in the overload relay to provide the abutting electrical connection.

6. The starter of claim 5 wherein the at least one retaining projection is t-shaped to permit entry of the retaining projection into the receiving channel and prevent removal of the retaining projection through the retaining channel when the contactor is coupled with the overload relay.

7. The starter of claim 5 wherein the overload relay further includes a potentiometer secured therein and wherein the cover in the cover closed position covers the potentiometer.

8. The starter of claim 1 wherein the overload relay further includes a magnetic flux concentrating shield connected to and residing in the overload relay housing.

9. The starter of claim 8 wherein the magnetic flux concentrating shield comprises:

a plurality of pole sections, each pole section having an aperture to receive a conductor transversely therethrough and comprising:

a primary magnetic flux path having an air gap;

a secondary continuous magnetic flux path;

a magnetic flux sensor disposed within the air gap of the primary magnetic flux path; and a plurality of pole shielding slots within the magnetic flux concentrating shield, such that when electrical current flows through the conductor of each pole section, a resultant magnetic flux flowing in the direction of each primary magnetic flux path is substantially prevented by the pole shielding slots from reaching the magnetic flux sensor of another of the plurality of pole sections, thereby minimizing cross-pole magnetic flux sensor interference.

10. The starter of claim 8 wherein the magnetic flux concentrating shield comprises a plurality of laminated members.

11. The starter of claim 1 wherein the contactor housing includes a conductor lug and the overload relay includes a cover mounted on an overload relay housing and pivotable between a cover open position and a cover closed position such that the cover can be pivoted from the cover closed position to permit viewing of a conductor extending into the conductor lug.

12. The starter of claim 11 wherein the cover has at least one aperture such that a locking hasp attached to the overload relay housing projects through the aperture in the cover may be sealed to lock the cover.

13. The starter of claim 11 wherein the cover open position permits viewing of a conductor inserted through the overload relay and into the conductor lug of the contactor housing during installation of the conductor.

14. The starter of claim 11 wherein the overload relay has a housing which includes a full load amperage adjustment potentiometer disposed thereon such that when the cover is in the cover closed position and the locking hasp is sealed, access to and adjustment of the full load amperage adjustment potentiometer is prevented.

15. A starter comprising:

a multi phase DC controlled contactor comprising:

at least one stationary contact mounted within a contactor housing having at least one connecting slot;

a moveable contact mounted in operable association with the stationary contact;

a moveable contact carrier slidably mounted to the contactor housing;

an electromagnetic coil attached to the contactor housing for attracting the moveable contact carrier;

a platform extending from the contactor housing and having a plurality of coil supports attached thereto;

at least one flexible coil terminal attached at one end to the electromagnetic coil and extending out from the contactor housing onto the coil supports;

an overload relay interlockingly coupled with the contactor comprising:

at least one retaining projection extending from the overload relay;

a flexing lock tab integral with each retaining projection;

a printed circuit board residing within an overload relay housing for controlling power to the contactor;

a magnetic flux concentrating shield connected to and residing in the overload relay housing comprising:

a plurality of pole sections, each pole section having an aperture to receive a conductor transversely therethrough and comprising:

a primary magnetic flux path section having an air gap;

a magnetic flux sensor disposed within the air gap of the primary magnetic flux path section and operatively associated with the printed circuit board; and a plurality of pole shielding slots, such that when electrical current flows through the conductor of each pole section, a resultant magnetic flux flowing in the direction of each primary magnetic flux path is substantially prevented by the pole shielding slots from reaching the magnetic flux sensor of another of the plurality of pole sections, thereby minimizing cross-pole magnetic flux sensor interference;

wherein the connecting slot has a receiving channel to receive the retaining projection and a retaining channel narrower than the receiving channel such that when the contactor is coupled to the overload relay the retaining projection enters the receiving channel of the connecting slot and proceeds downwardly through the retaining channel until the flexing lock tab snaps into a lip of the contactor, thereby preventing removal of the overload relay from the contactor; and wherein when the contactor is coupled to the overload relay the flexible coil terminal abuts an electrical conductor on the printed circuit board to provide an electrical connection between the contactor and the overload relay.

16. The starter of claim 15 wherein the magnetic flux concentrating shield comprises a plurality of laminated members.

17. The starter of claim 15 wherein the contactor further includes an arc shield attached to the contactor housing at each stationary contact and wherein the arc shield is deep drawn to eliminate openings and facilitate electrical arc retention and gas containment within the arc shield, thereby avoiding carbon build-up within the contactor housing.

18. The starter of claim 15 wherein the contactor housing includes a conductor lug and the overload relay includes a cover mounted on an overload relay housing and pivotable between a cover open position and a cover closed position such that the cover can be pivoted from the cover closed position to permit viewing of a conductor extending into the conductor lug.

19. The starter of claim 18 wherein the cover has at least one aperture such that a locking hasp attached to the overload relay housing projects through the aperture in the cover may be sealed to lock the cover.

20. The starter of claim 15 wherein the at least one retaining projection is t-shaped to permit entry of the retaining projection into the receiving channel and prevent removal of the retaining projection through the retaining channel when the contactor is coupled with the overload relay.

21. The starter of claim 18 wherein the overload relay further includes a potentiometer secured therein and wherein the cover in the cover closed position prevents access to the potentiometer.

22. The starter of claim 15 wherein the contactor further includes a reciprocating guide pin attached to the moveable contact carrier and moveable along at least one guide surface on the contactor housing such that the moveable contact carrier and the guide pin have a substantially smooth path while traveling along the guide surface.

23. The starter of claim 15 wherein there are three pole sections.

24. A contactor assembly comprising:

at least one stationary contact mounted within a contactor housing;

a moveable contact mounted in operable association with the stationary contact;

a moveable contact carrier slidably mounted to the contactor housing;

an electromagnetic coil mounted to the contactor housing for attracting the moveable contact carrier;

at least one flexible coil terminal attached at one end to the electromagnetic coil and extending out through the contactor housing; and a circuit board housing interlockingly coupled with the contactor and including a printed circuit board residing within the circuit board housing;

wherein an abutting electrical connection between the flexible coil terminal and the printed circuit board is made when the circuit board housing is coupled to the contactor.

25. The contactor assembly of claim 24 wherein the contactor further comprises a platform extending from the contactor housing and having a plurality of coil terminal supports attached thereto, and wherein the circuit board housing further comprises at least one retaining projection extending from the circuit board housing and a flexing lock tab integral with the circuit board housing;

wherein the contactor has a receiving channel to receive the retaining projection and a retaining channel narrower than the receiving channel such that when the contactor is coupled to the circuit board housing the retaining projection enters the receiving channel and proceeds downwardly through the retaining channel until the flexing lock tab snaps into the contactor housing to achieve a snap lock connection between the circuit board housing and the contactor; and wherein when the contactor is coupled to the circuit board housing the flexible coil terminal abuts an electrical conductor on the printed circuit board in the circuit board housing to provide the abutting electrical connection.

* * * * *